US009475670B2

(12) United States Patent
Barea

(10) Patent No.: US 9,475,670 B2
(45) Date of Patent: Oct. 25, 2016

(54) YARN FEEDER OF STORAGE TYPE WITH MAGNETIC BRAKE

(71) Applicant: Tiziano Barea, Busto Arsizio (Varese) (IT)

(72) Inventor: Tiziano Barea, Busto Arsizio (Varese) (IT)

(73) Assignee: BTSR INTERNATIONAL S.P.A., Olgiate Olona (Varese) (IT)

( * ) Notice: Subject to any disclaimer, the term of this patent is extended or adjusted under 35 U.S.C. 154(b) by 347 days.

(21) Appl. No.: 14/353,806

(22) PCT Filed: Nov. 8, 2012

(86) PCT No.: PCT/IB2012/002325
§ 371 (c)(1),
(2) Date: Apr. 24, 2014

(87) PCT Pub. No.: WO2013/072736
PCT Pub. Date: May 23, 2013

(65) Prior Publication Data

US 2014/0306051 A1 Oct. 16, 2014

(30) Foreign Application Priority Data

Nov. 17, 2011 (IT) ..... MI2011A002091

(51) Int. Cl.
*B65H 51/22* (2006.01)
*B65H 59/22* (2006.01)
(Continued)

(52) U.S. Cl.
CPC ..... *B65H 51/22* (2013.01); *B65H 59/22* (2013.01); *B65H 59/36* (2013.01); *D03D 47/364* (2013.01); *D03D 47/366* (2013.01); *D04B 15/484* (2013.01); *B65H 2701/31* (2013.01)

(58) Field of Classification Search
CPC ..... B65H 51/22; B65H 59/22; B65H 59/24; B65H 59/36; D03D 47/364; D03D 47/365; D03D 47/366; D04B 15/484
USPC ..... 242/365.4, 419.4, 147 M, 150 M
See application file for complete search history.

(56) References Cited

U.S. PATENT DOCUMENTS 3,637,149 A 1/1972 Frei
3,796,385 A 3/1974 Jacobsson
(Continued)

FOREIGN PATENT DOCUMENTS

CN 101057015 A 10/2007
CN 101343002 A 1/2009
(Continued)

OTHER PUBLICATIONS

Chinese Office Action dated Aug. 5, 2015,comments and search report, in corresponding Chinese patent application No. 201280056875.2.
(Continued)

*Primary Examiner* — William E Dondero
(74) *Attorney, Agent, or Firm* — Vorys, Sater, Seymour and Pease LLP

(57) ABSTRACT

Yarn feeder including a body carrying a drum on which turns of yarn from a spool are wound; a tension sensor for measuring exiting yarn tension value, a braking member including a first permanent magnet and a fixed second magnet, regulator for varying action the second magnet exerts on the first permanent magnet, and a control unit to control the regulator. The first magnet is annular and movable parallel to the axis of the drum and along it between a first position where the first permanent magnet enables pressing the yarn against a counteracting element fixed to the drum and a second position where this effect does not occur. The control unit receives tension values measured by the tension sensor, comparing them with a predetermined value and intervening in real time on the regulator to adjust tension value to predetermined value when these two values do not coincide.

14 Claims, 5 Drawing Sheets

(51) Int. Cl.

| | |
|---|---|
| ***B65H 59/36*** | (2006.01) |
| ***D03D 47/36*** | (2006.01) |
| ***D04B 15/48*** | (2006.01) |

(56) References Cited

U.S. PATENT DOCUMENTS

| | | | |
|---|---|---|---|
| 3,843,069 | A | 10/1974 | Deniega et al. |
| 3,883,083 | A | 5/1975 | Rosen |
| 4,180,215 | A | 12/1979 | Nurk |
| 4,852,617 | A | 8/1989 | Hamer et al. |
| 5,240,194 | A | 8/1993 | Noirot et al. |
| 5,421,534 | A | 6/1995 | Arnold et al. |
| 2008/0210804 | A1 | 9/2008 | Barea |
| 2008/0296425 | A1 | 12/2008 | Comotto et al. |
| 2009/0178757 | A1 | 7/2009 | Cocovi et al. |
| 2012/0037601 | A1 | 2/2012 | Watanabe et al. |

FOREIGN PATENT DOCUMENTS

| | | | |
|---|---|---|---|
| DE | 4104087 | A1 | 8/1991 |
| DE | 4313255 | A1 | 10/1994 |
| DE | 102004020465 | B3 | 9/2005 |
| EP | 0424770 | A2 | 5/1991 |
| EP | 0652312 | A1 | 5/1995 |
| EP | 2014809 | A1 | 1/2009 |
| EP | 2031610 | A1 | 3/2009 |
| FR | 2655888 | A1 | 6/1991 |
| WO | 2006133662 | A1 | 12/2006 |
| WO | 2007006411 | A1 | 1/2007 |
| WO | 2007048528 | A1 | 5/2007 |
| WO | 2007096765 | A1 | 8/2007 |
| WO | 2010116412 | A1 | 10/2010 |
| WO | 2013/064879 | A1 | 5/2013 |
| WO | 2013/088233 | A1 | 6/2013 |
| WO | 2013/093592 | A1 | 6/2013 |
| WO | 2013/098631 | A1 | 7/2013 |

OTHER PUBLICATIONS

International Search Report mailed Feb. 21, 2013 for PCT/IB2012/002325 to BTSR International S.P.A. filed Nov. 8, 2012.

U.S. Appl. No. 14/353,728 to Tiziano Barea, "Positive Feeder Device for Feeding Metal Wires At Constant Tension," filed Apr. 23, 2014. (US National Stage of WO 2013/064879 A1).

U.S. Appl. No. 14/353,867 to Tiziano Barea, "Device for Feeding Yarn to a Textile Machine," filed Apr. 24, 2014. (US National Stage of WO 2013/088233 A1).

U.S. Appl. No. 14/354,211 to Tiziano Barea, "Method and Device for Storing Yarn in Order to Feed Thread Without Creating Twisting Thereof," filed Apr. 25, 2014. (US National Stage of WO 2013/093592 A1).

U.S. Appl. No. 14/354,279 to Tiziano Barea, "System and Method for Feeding Metal Wires At Constant Tension," filed Apr. 25, 2014. (US National Stage of WO 2013/098631 A1).

YARN FEEDER OF STORAGE TYPE WITH MAGNETIC BRAKE

CROSS-REFERENCE TO RELATED APPLICATIONS

This is a §371 National Stage Application of International Application No. PCT/IB2012/002325 filed on 8 Nov. 2012, claiming the priority of Italian Patent Application No. MI2011A002091 filed on 17 Nov. 2011.

The present invention relates to yarn feeders of storage type for textile applications, provided with the so-called "brake" for controlling the tension of the yarn fed to a textile machine.

Various types of such feeders are known in which the yarn withdrawn from a spool is wound in turns on a drum before being fed to the textile machine. At that drum end from which the wound yarn leaves the drum, the aforesaid "brake" is provided, i.e. a braking member for the exiting yarn, essentially comprising an internally frustoconical annular element disposed coaxially to the drum and arranged to cause the exit yarn leaving the drum (at the so-called exit point) to be pressed against it, so as to "brake" this yarn and control the tension at which it is withdrawn by the textile machine.

Two types of "brake" of frustoconical annular element type are known, using different methods for controlling the "braking":

I. The frustoconical annular element is held in position and pressed against the drum by one or more preloaded springs, such that the force exerted by the springs determines the average tension of the yarn fed to the textile machine. The springs also act as a shock absorber when a knot formed in the yarn passes through the brake, so enabling yarn breakage to be avoided.

II. The frustoconical annular element is held in position and pressed against the drum by the action of one or more magnets. The intensity of the magnetic field determines the average tension of the exiting yarn. The use of magnets also enables a damping effect to be achieved if a knot passes, given that the frustoconical annular element also moves in this case to allow the knot to pass and prevent yarn breakage.

A yarn feeder with a braking member of type II, which uses in particular the repulsion effect of two permanent magnets, is described for example in US 2008/296425 and EP-A-2065496 which use two mutually repelling magnets for the purpose. EP-A-2065496 provides a mechanism which enables the operator to manually vary the relative position of the two permanent magnets (which however then remains constant with time until the next manual adjustment) such as to be able to vary the braking effect on the yarn. This manual braking adjustment mechanism is however not able to guarantee a constant yarn tension in the exit yarn as the operative conditions vary. In particular, the average tension applied to the exit yarn is also a function of the unwinding tension of the yarn from the spool during yarn loading onto the feeder drum, and of the velocity of yarn withdrawal by the textile machine. This is because each yarn has its intrinsic elasticity and the tension differences during yarn unwinding from the drum cause it to undergo different elongations. The consequence is that as the tension in the entering yarn (i.e. that originating from the spool to be wound onto the drum) varies, the yarn becomes deposited on the drum such that it presses on the drum to a greater or lesser extent, but the variation of the tension in the entering yarn (for example between the situation in which the spool is full and that in which the spool is close to being empty) can evidently not be compensated by said is manual adjustment mechanism. Moreover this tension variation in the yarn wound onto the drum can also give rise to false measurements of the yarn feed velocity from the feeder to the textile machine. As known to the experts of the art, this velocity is a function of the yarn feed tension. In particular, for yarns of limited elasticity, on using the aforedescribed brake-fitted feeders, the greater the tension, the lesser is the velocity, and consequently the lesser the tension, the greater is the velocity.

It should also be noted that the operator is compelled to periodically verify the operation of these feeders, and in particular the value of the average tension in the exit yarn, including on account of the wear of the braking member, and hence to act on said manual adjustment mechanism to compensate the effect of wear on the exit yarn tension.

To overcome these limits, storage feeders have been produced, of the type indicated above by I (i.e. using springs), which also comprise at their exit a sensor for measuring the yarn tension and an electronic regulator for the pressure exerted by the brake on the drum. See for example EP-A-2014809, in which electronic control means are provided able to measure by means of a sensor the tension in the exit yarn, together with mechanical means for varying the position of the frustoconical braking element using a small stepping motor, to hence regulate the average tension of the exit yarn. In these feeders, the fact of continuously measuring the tension in the exit yarn makes it possible to compensate the average variation of this tension.

However because of their method of regulating the tension (by a worm driven by a stepping motor), these feeders present the not inconsiderable drawback that, although being able to perfectly compensate slow tension variations (in particular due to passage from the full spool situation to the empty spool situation, or due to wear of the frustoconical braking element), they are unable by virtue of their nature to compensate rapid tension variations (for example due to the passage of knots in the yarn, due to velocity change of the textile machine, or to tension peaks due to the spool) which can cause one or two turns to deposit on the drum which are of different tension from the others.

Another drawback of these feeders is that they have a very limited range of utilization tensions (unless mechanical intervention is carried out on the braking member to substitute certain parts, e.g. by replacing the frustoconical element with another of different thickness). In this respect, the minimum tension is limited by the weight of the frustoconical element whereas the maximum tension requires a frustoconical element specifically designed to be as light as possible, however this wears very rapidly.

WO 2007/048528 describes an apparatus for automatically controlling the length of a yarn fed to a knitting system in a knitting machine.

This apparatus comprises a body comprising a yarn storage member, defined by a fixed or stationary drum, relative to which a winding element rotates to receive the yarn from a spool; a device is provided for measuring the yarn length fed to the textile machine, as is a tensioning member controlled by an electronic control unit.

This tensioning member comprises a frustoconical body positioned at the end of the fixed drum and radially flexible, this body operating as a brake by acting on the yarn which separates from the drum and is directed to the textile machine. The frustoconical body has a cylindrical extension supporting a magnetic ring or, alternatively, a plurality of permanent magnets distributed circumferentially on said cylindrical extension.

Spaced from this latter there is another permanent magnet or a plurality of radially distributed permanent magnets fixed to a stationary part of the tensioning member, this stationary part being associated with the apparatus body but whose position relative to the fixed drum can be manually adjusted.

This adjustment enables the relative position between the magnet or magnets of the stationary part and that or those associated with the frustoconical body positioned at the yarn to be varied.

The stationary part of the tensioning member also supports a solenoid which is electronically powered in a variable manner as a function of the measurement of the length of the yarn leaving the apparatus and directed to the textile machine.

This variable electrical powering of the solenoid enables the braking force of the frustoconical body on the yarn to be varied such as to maintain a fed yarn length equal to a desired value.

Hence the aforedescribed prior solution comprises a frustoconical body acting on the yarn present on the drum which has necessarily to be fixed in order to enable an appropriate braking of this body such that the braking takes place by pressing on the yarn present on the drum.

In addition, this prior solution presents the drawback of only a limited withdrawal of the frustoconical body from the drum, making it difficult to insert between them the yarn which is to be directed to the textile machine when the known apparatus is started.

Moreover, precisely because of the manner in which the yarn is braked (which takes place by pressing it against the drum), the known solution must comprise a mechanical constraint between the frustoconical body and stationary part of the tensioning member in order to maintain this body in proximity to the drum even when the apparatus is not used.

An object of the present invention is therefore to provide a storage feeder, provided with a brake, which is able to effectively control the exiting yarn tension in any situation, such as to make the value of this tension equal in real time to a predetermined reference value.

Another object consists of providing a feeder of the stated type which enables the time variation of the yarn exit tension (working tension of the textile machine) to be programmed, i.e. to have a reference tension which varies with time in the required manner, to hence achieve particular effects on the finished product.

Another object consists of providing a feeder of the aforesaid type which facilitates the "insertion" stage (initial loading of the yarn onto the drum) by providing automatic opening of the brake.

Another object consists of providing a feeder of the aforesaid type which has an operating tension range greater than that of known feeders.

A further object consists of providing a feeder of the aforesaid type in which the braking member is not influenced in practice by wear due to the passage of the yarn.

A further object consists of providing a feeder of the aforesaid type which is able to instantly nullify the tension applied to the yarn fed to the textile machine in order to facilitate certain particularly delicate processing stages of is this latter (for example the sucking-in of the yarn during its exit from the thread guide on circular machines).

Another object is to provide a feeder of the aforesaid type which can be either of fixed drum type or of rotary drum type at choice.

These objects are attained by the yarn feeder of storage type with braking member, in accordance with the accompanying claims.

The invention will be more easily understood from the ensuing description of some embodiments thereof provided by way of example. In this description reference is made to the accompanying drawings, in which.

Figure 1:
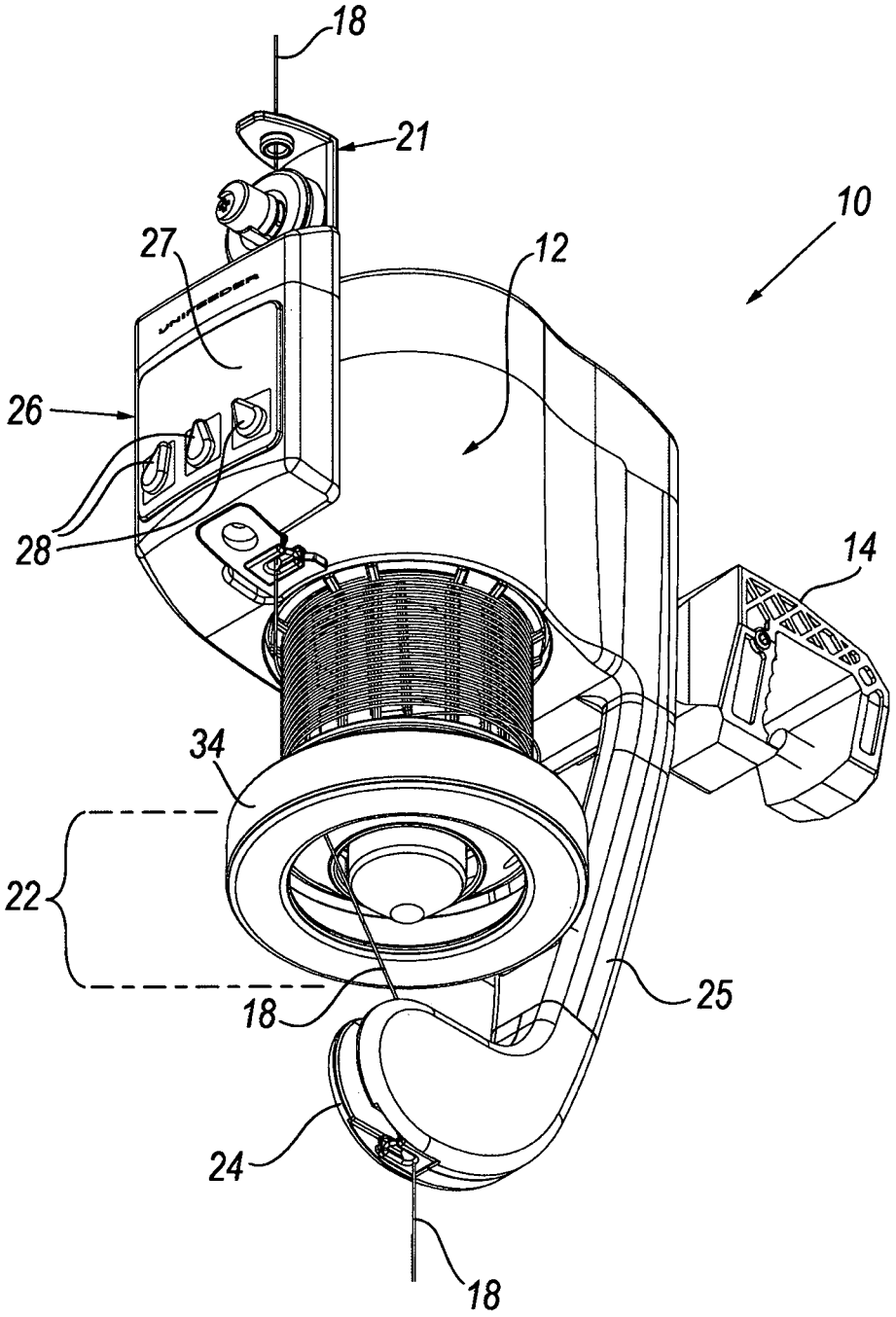
FIG. 1 is a perspective view of a feeder according to the present invention.

As can be seen from the figures, the yarn feeder, indicated overall by 10, is of storage type and comprises a main body 12 carried by a suitable support 14 and carrying a drum 16 of vertical axis, on which a determined number of turns 20 of a yarn 18 originating from a spool (not shown) are wound. The entering yarn 18, i.e. before reaching the drum 16, normally passes through one or more thread guides (of which one, indicated by 21, is visible in FIGS. 1 and 2) which define its inlet trajectory and prevent the yarn 18 from coming into contact with the body 12. The task of the drum 16 is to store a predetermined (possibly programmable) number of turns 20 of yarn 18 originating from the spool, to be fed to a textile machine (not shown). The drum 16 enables the turns to be simultaneously separated such that they cannot straddle each other and consequently "pinch" together. In the embodiment of the invention, this drum is of rotary type driven by its own motor 16A.

Before leaving the feeder 10, the yarn 18 passes through a braking member indicated overall by 22. Ignoring for the moment how this latter is formed, it can be seen from FIGS. 1 and 2 that the exit yarn 18 passes through a conventional sensor 24 which continuously measures its outlet tension by is known procedures, sending the measured tension value to a control unit 26 of microprocessor type, of which the display 27 and the controls 28 are shown in FIG. 1. The sensor 24 is fixed to the body 12 by an arm 25.

Figure 3:
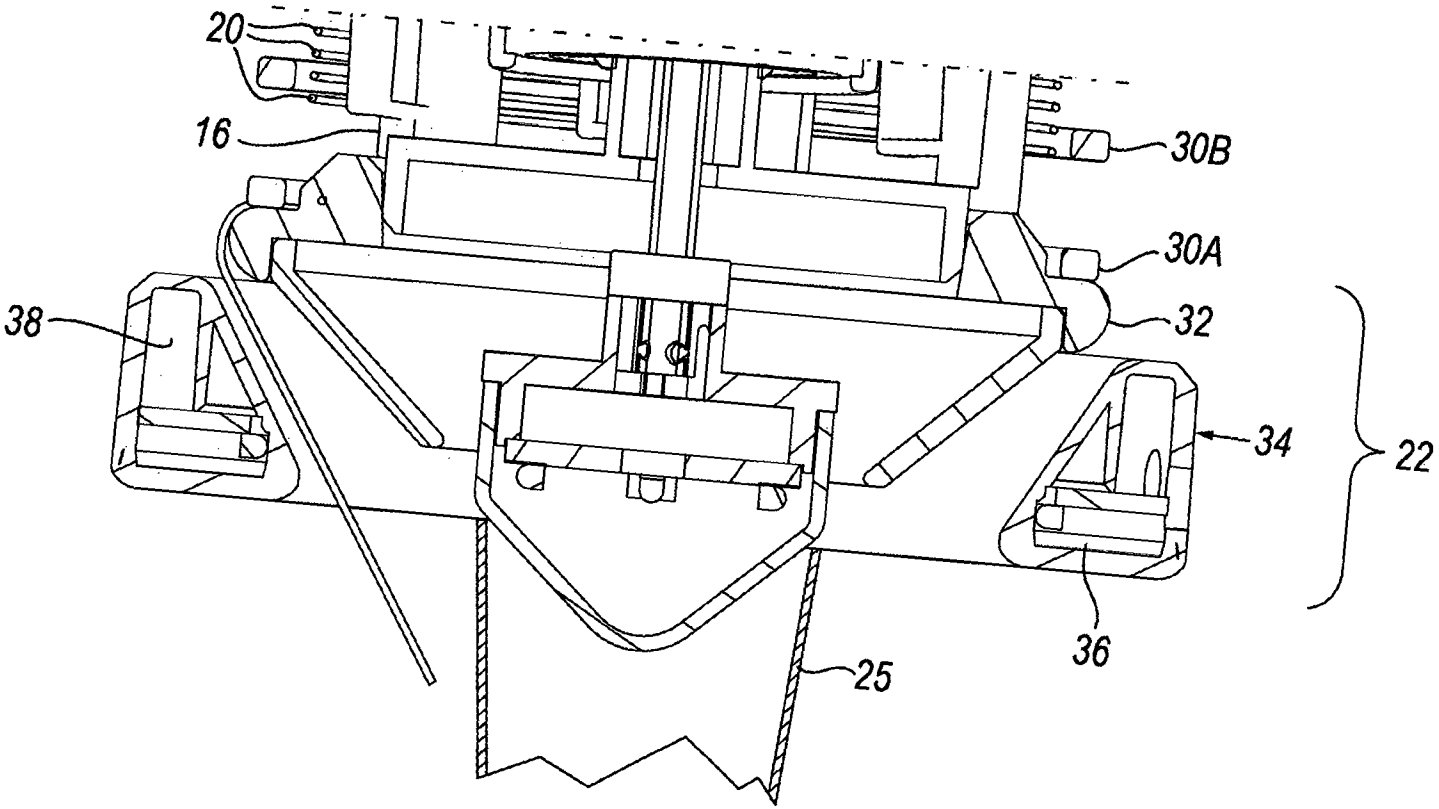
FIG. 3 is an enlarged partial vertical cross-section again taken along the drum axis, but in a plane perpendicular to that of FIG. 2.

Returning to the braking member 22, this comprises a first permanent magnet 30 of ring shape in this specific case, of which FIG. 3 shows both the end working positions (evidently not simultaneous) indicated respectively by 30A and 30B. The annular permanent magnet 30, which can assume any position between said end positions 30A and 30B, has a diameter greater than the drum 16 on which turns 20 of yarn 18 are wound and is disposed coaxially to the drum and to said turns. The annular magnet 30 is free to move along the drum, to reach any position thereon by virtue of its greater diameter than this latter.

An amagnetic annular counteracting or abutting element 32 (in particular of amagnetic stainless steel), which acts as a limit stop for the first permanent magnet 30 when it moves into its position 30A, is fixed to the body 12 coaxially to the drum 16, This counteracting element is hence rigid with this latter.

An annular support 34 is also fixed to the body 12 by the arm 25, and is also disposed coaxial to the drum 16. A second magnet, in this specific case a permanent magnet 36 also of ring shape, is fixed to said annular support 34 and disposed coaxial to the drum 16. In the illustrated case (and as will be better seen hereinafter) the poles of the second permanent magnet 36 can be disposed such as to have an attraction or repulsion effect on the first permanent magnet 30.

In the specific illustrated case, an electromagnet 38 (consisting essentially of an electrically powered winding) is fixed coaxially to the annular support 34, the arrangement of its poles being able to have an attractive or repulsive effect on the first permanent magnet 30. The electromagnet 38 is obviously connected to the control unit 26, which is hence able to regulate the intensity of the current flowing through said winding and also the direction of this current, and consequently the ability to modulate the generated magnetic field.

The illustrated situation allows two different solutions, depending on how the is poles of the two permanent magnets 30 and 36 are disposed:

1) the two permanent magnets 30 and 36 mutually repel, so that the first 30 tends to withdraw from the second 36, to assume the position 30B which is more distant from 30A the stronger the magnetic repulsion force;
2) the two permanent magnets 30 and 36 mutually attract, so that the first 30 tends to approach the second 36, to assume the position 30A, and to thrust towards the counteracting element 32 with a force which is greater the greater the magnetic attraction force.

As can be seen from FIG. 3, the yarn 18 is inserted between the counteracting element 32 and the first permanent magnet 30 (to then pass from the tension sensor 24). This operation is facilitated by being able to bring the magnet 30 into any position along the drum 16 away from the counteracting element 32 by virtue of the diameter of the annular element 30, which is greater than that of the drum (and of the yarn disposed on it).

During use:

when the first permanent magnet 30 lies in the position 30B (distant from the element 32 and along the drum) the yarn 18, in leaving the drum 16, does not undergo any braking effect on exiting, so that it is withdrawn by the textile machine (as stated, not shown) at so-called "zero tension" (although in practice there is a minimum tension caused by the friction between the yarn and the other parts of the feeder 10);

when the first permanent magnet lies in the position 30A the yarn 18, in leaving the drum 16, is squeezed between the first permanent magnet and the counteracting element 32 before reaching the tension sensor 24, with the result that the yarn is more strongly braked the higher the attraction force of the two permanent magnets 30 and 36. Hence the invention, contrary to known solutions, enables the yarn to be braked by squeezing it between the annular first magnet 30, freely movable along and parallel to the drum 16, and the counteracting element 32 fixed to one end (or in a position corresponding therewith) of said drum.

Hence this braking action is performed in the direction of the yarn movement in withdrawing from or leaving the drum and not towards the drum, as in known solutions in which the yarn is pressed onto the drum in order to brake it.

This different action enables a facilitated yarn "insertion" to be achieved into the braking member 22 (between the annular first magnet 30 and the counteracting element associated with the drum 16) and also facilitates the production of this member 22 which, during assembly, presents no element which has to be retained by an operator (who draws the annular first magnet 30 onto the drum 16 and fixes the element 32 to this latter by locking this magnet onto the drum), with evident saving in assembly time (even after a parts replacement for maintenance) and in the relative costs.

It follows that, ignoring the configuration chosen for the two permanent magnets (in attraction or in repulsion), the control unit, by suitably activating and modulating (in accordance with known P, PI, PID and similar algorithms) the magnetic field generated by the electromagnet 38 (which therefore functions as a regulator means), can modify both the position 30B of the first permanent magnet 30, and the squeezing force on the yarn 18 exerted by the first permanent magnet 30 when in its position 30A on the counteracting element, the tension of the exiting yarn 18 withdrawn by the textile machine depending directly on this squeezing force.

In particular, in the configuration in which the two permanent magnets 30 and 36 mutually attract (for which the first permanent magnet 30 is in position 30A and presses on the yarn 18 to squeeze it against the counteracting element 32), the magnetic field generated by the electromagnet 38 can nullify, reduce or increase the attraction force and hence the squeezing force, to hence, by means of the suitably programmed control unit 26, be able to regulate (in practice in real time) the tension in the exit yarn 18 and thus obtain at any moment the required tension in the exit yarn 18, equal to the reference tension (this latter being able to be made variable with time by suitably programming the control unit 26).

In the arrangement in which the two permanent magnets 30 and 36 mutually repel, for which the first permanent magnet 30 tends to move into position 30B, such that it exerts no force on the yarn 18, the magnetic field generated by the electromagnet 38 can not only nullify the repulsion between the two permanent magnets 30 and 36, but can even act such that the electromagnet 38 attracts the first permanent magnet 30, to hence press the yarn 18 against the counteracting element 32 and in practice generate in real time, by virtue of the intervention of the control unit 26, the required tension in the exit yarn 18.

It has been seen that the aforedescribed solutions enable a usable tension range to be achieved which is decidedly greater than that of known feeders.

In order to eliminate for practical purposes the wear caused by the rubbing of the yarn 18 against the counteracting element 32 and against the first permanent magnet 30, the two can be covered, at least on those of their parts which come into contact with the yarn 18, by a conventional woven ceramic or other antiwear material (for example by chromium-plating). Moreover, the annular first magnet 30 can cooperate with a body (for example conical) arranged to interact directly with the counteracting element 32 to brake the yarn. This body can be or not be associated with the (movable) magnet 30 such as not to impede the movement of this latter along the drum.

Figure 5:
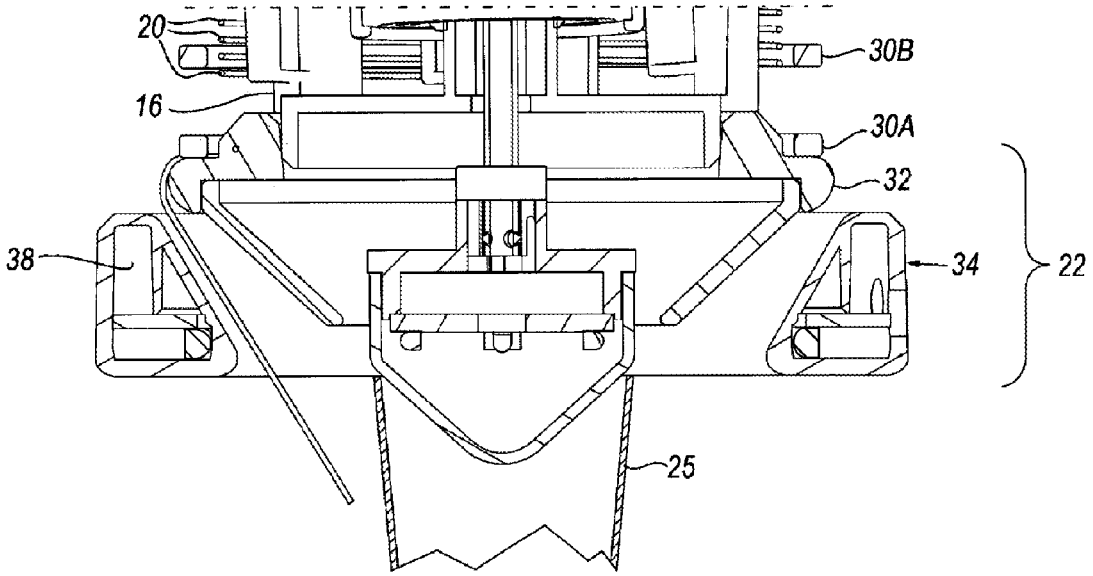
FIG. 5 shows an alternative embodiment.

According to a variant of the invention shown in FIG. 5, the second magnet is an electromagnet. In practice, it is as if in FIG. 3 the permanent magnet 36 were not present and the electromagnet 38 were said second magnet, performing also the function of regulator means, as the action which it exerts on the first permanent magnet can be varied at will, by virtue of the intervention of the control unit 26 which suitably varies the intensity of the magnetic field generated by the electromagnet 38.

Figure 2:
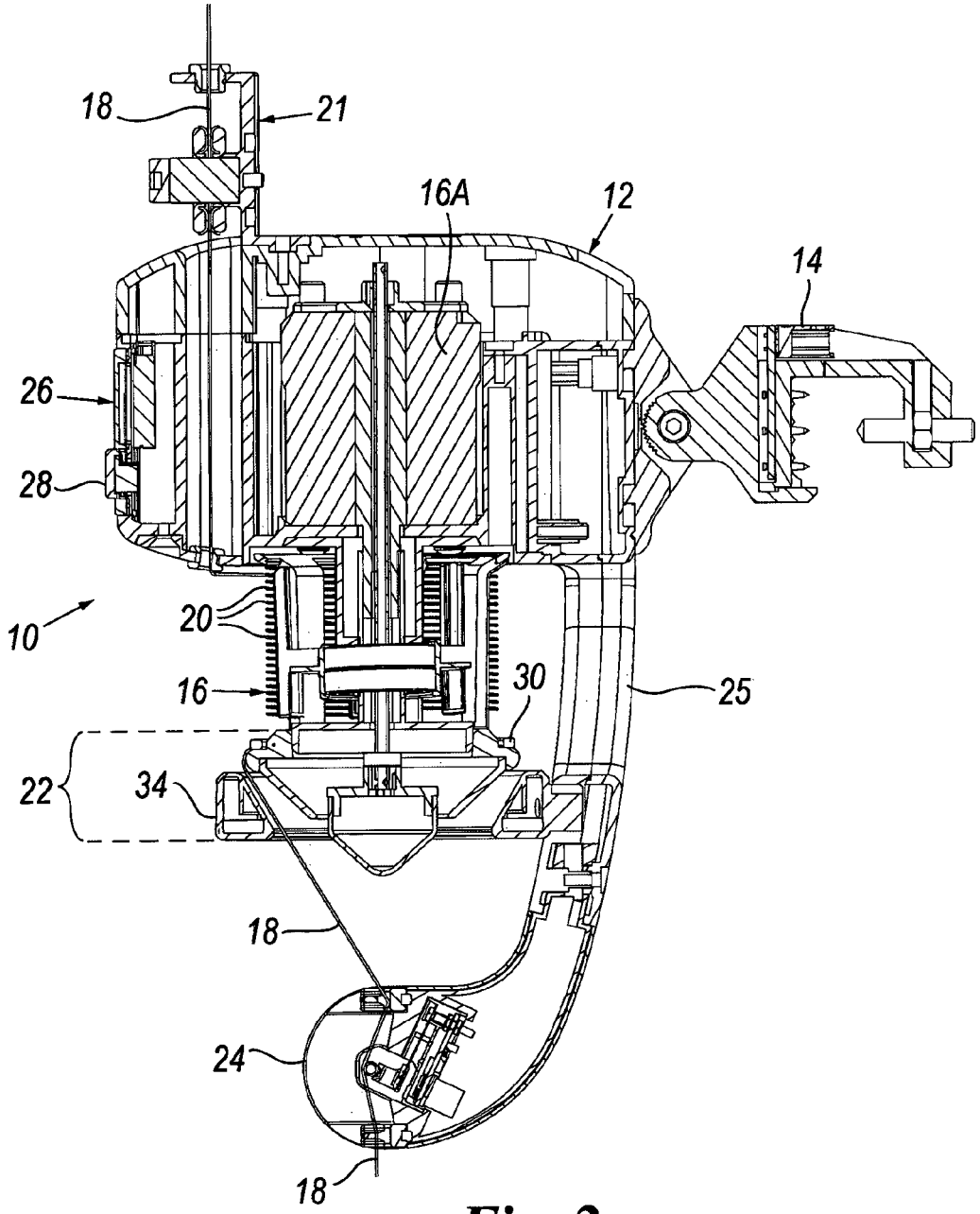
FIG. 2 is a vertical cross-section taken along the drum axis.
Figure 4:
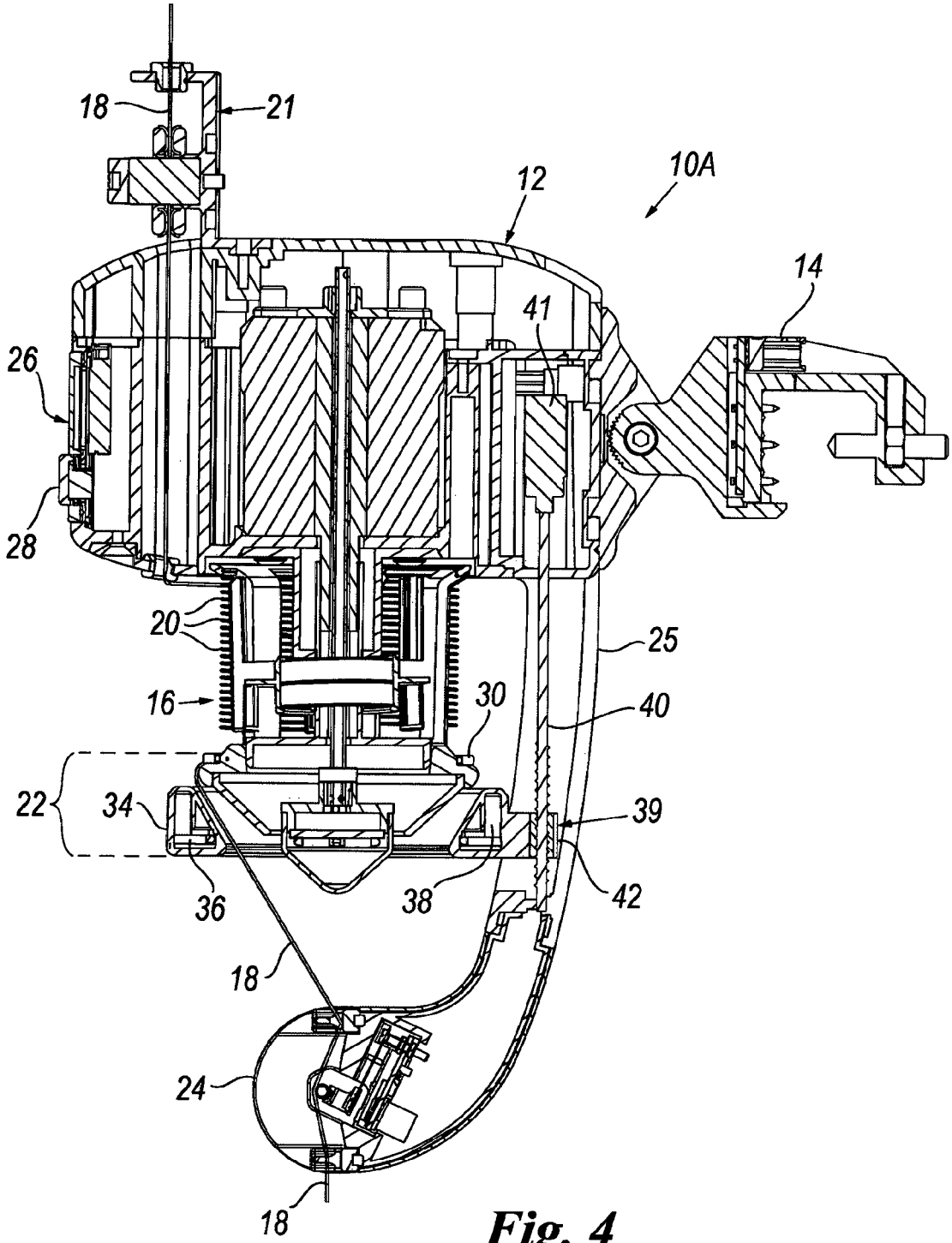
FIG. 4 is a cross-section similar to that of FIG. 2, but of a different embodiment of the invention.

In another variant, indicated by 10A in FIG. 4 (in which elements equal or similar to those of FIG. 2 are indicated by the same reference numerals), the second magnet is also a permanent magnet 36. In this case the regulator means comprise a motorized mechanism, indicated overall by 39, which when commanded by the control unit 26 is able to vary in real time the position of the second permanent magnet 36 relative to the first permanent magnet 30, to regulate the tension in the exit yarn 18. Said motorized mechanism comprises in this specific case a worm 40 rotated by a servomotor 41 (in particular of the stepping type) connected to the control unit 26, enabling the worm 40 to be rotated about its axis in both directions. is The worm 40 is inserted through a bush 42 provided with a female thread, the annular support 34 containing the second permanent magnet 36 being fixed to the bush 42. Consequently, by operating the servomotor 41 by the action of the control unit 26, the second permanent magnet 36 (contained in the annular support 34) can be made to withdraw from or approach the first permanent magnet 30 to regulate the tension in the exit yarn 18.

In a further variant (for the description of which reference should be again made to FIG. 4), the second magnet is an electromagnet 38 (also shown in FIG. 4 for simplicity, it being however clear that in this and the preceding variant only the electromagnet 38 or only the permanent magnet 36 is present respectively). The electromagnet 38 can form part of said regulator means which comprise in this latter case a motorized mechanism such as that just described and indicated by 39, again controlled by the control unit 26.

Although already mentioned in the description of the first embodiment of the present invention, it should be noted that by having a control unit 26 of microprocessor type, in all the described embodiments a reference tension value can be set which is variable in time in a manner programmable by the control unit. In particular, said reference value can be varied on the basis of synchronism signals originating from the textile machine, which identify its different operative stages (for example one or more cylinder rotation pulses for a circular machine), or by a connection via field bus (RS485, CAN BUS, ETHERNET and the like).

The braking member 22 can also comprise a specific magnet, of permanent type (for example the magnet 36) or an electromagnet, the only function of which is to centre the first permanent magnet 30 relative to the drum 16, and/or which enables the weight of the first permanent magnet 30 to be nullified, that magnet being of smaller, equal or greater diameter than this latter.

It should be noted that although in the figures showing the feeder 10 and 10A the first permanent magnet 30 is disposed above the counteracting element 32, evidently a variant in which the respective position of these elements is inverted, i.e. with the counteracting ring located above the first permanent magnet, so that to brake the yarn 18 the first permanent magnet must be made to move upwards, against the counteracting ring, also falls within the scope of the present invention.

From the aforegoing it is apparent that by virtue of the present invention, a yarn feeder of storage type can be obtained which enables all the aforelisted objects to be attained. In particular the feeder of the present invention can evidently be of fixed drum or rotary drum type.

The invention claimed is:

1. A yarn feeder for textile applications, of storage type, comprising:

a body carrying a drum on which turns of yarn originating from a spool are wound;

a braking member associated with the drum arranged to act on the yarn as the yarn leaves the drum under withdrawal by a textile machine, the braking member being of the type using magnets and comprising:

a first permanent magnet movable relative to the drum and at least one fixed second magnet, regulator means to vary the action exerted by the second magnet on the first magnet, a control unit arranged to operate on said regulator means to control intervention of said regulator means on said second magnet, a tension sensor to measure the value of the tension in the yarn leaving the drum;

wherein the first permanent magnet is shaped as a ring freely movable parallel to the axis of the drum and along the drum, and arranged to cooperate with a counteracting element rigid with the drum, the yarn being disposed, on undergoing braking, between said annular first magnet and said counteracting element, said annular first magnet having a diameter greater than that of the drum to be able to move along and parallel to this drum to assume a working first position in which the first permanent magnet presses the yarn exiting the drum against the counteracting element, and a second position in which this effect does not take place, the braking action taking place by squeezing the yarn between said first freely movable annular magnet and said counteracting element rigid with the drum in the direction of movement of the yarn exiting the drum, the fixed second magnet enabling the first permanent magnet to be maintained in the first or in the second of the first permanent magnet's said positions; the control unit for receiving the tension values measured by the tension sensor, comparing them with a predetermined tension value and intervening in real time on said regulator means such that they regulate the action exerted by the second magnet on the annular first magnet to obtain a braking action of this annular first magnet on the yarn such as to adjust the tension value to the predetermined value.

2. A yarn feeder as claimed in claim 1, wherein the regulator means comprise an electromagnet constituting the second magnet, the intensity of the magnetic field generated by the electromagnet being able to be varied by the control unit to regulate the tension in the exiting yarn.

3. A yarn feeder as claimed in claim 1, wherein the second magnet is a permanent magnet, the regulator means comprising an electromagnet, the intensity of the magnetic field generated by the electromagnet being able to be varied by the control unit to vary the action of the magnetic field of the second permanent magnet on the first permanent magnet.

4. A yarn feeder as claimed in claim 1, wherein the regulator means comprise a permanent magnet constituting the second magnet, and a motorized mechanism arranged to vary in real time the position of the second magnet relative to the first permanent magnet under the control of the control unit, to regulate the tension in the exiting yarn.

5. A yarn feeder as claimed in claim 1, wherein the predetermined tension value is variable in time in a manner programmable by the control unit as a function of the different operative stages of the textile machine.

6. A yarn feeder as claimed in claim 1, wherein the braking member comprises a further magnet, of permanent type or an electromagnet, which enables the first permanent magnet to be centred relative to the drum.

7. A yarn feeder as claimed in claim 1, wherein if the drum has a vertical axis, the braking member comprises a further magnet, of permanent type or an electromagnet, which enables the weight of the first permanent magnet to be nullified.

8. A yarn feeder as claimed in claim 1, wherein the counteracting element and the first permanent magnet are covered, at least on those of their parts which come into contact with the yarn, with an antiwear material.

9. A yarn feeder as claimed in claim 8, wherein the antiwear covering material is a textile ceramic.

10. A yarn feeder as claimed in claim 8, wherein the antiwear covering material is obtained by chromium plating.

11. A yarn feeder as claimed in claim 1, wherein the annular first magnet cooperates with a portion shaped to interact directly with the counteracting element to brake the yarn.

12. A yarn feeder as claimed in claim 11, wherein said portion is conical.

13. A yarn feeder as claimed in claim 1, wherein the predetermined tension value is variable and programmable.

14. A yarn feeder as claimed in claim 13, wherein the reference value variation is a function of the textile machine operative stages.

* * * * *